US009856104B2

(12) United States Patent
Fujita et al.

(10) Patent No.: US 9,856,104 B2
(45) Date of Patent: Jan. 2, 2018

(54) SHEET MANUFACTURING APPARATUS

(71) Applicant: SEIKO EPSON CORPORATION, Tokyo (JP)

(72) Inventors: Shigeo Fujita, Nagano (JP); Naotaka Higuchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 85 days.

(21) Appl. No.: 14/951,739

(22) Filed: Nov. 25, 2015

(65) Prior Publication Data

US 2016/0145801 A1 May 26, 2016

(30) Foreign Application Priority Data

Nov. 26, 2014 (JP) ..... 2014-238487

(51) Int. Cl.

| | |
|---|---|
| ***D21F 1/40*** | (2006.01) |
| ***D21F 1/02*** | (2006.01) |
| ***B65H 20/02*** | (2006.01) |
| ***B65H 23/02*** | (2006.01) |
| ***B65H 20/06*** | (2006.01) |
| ***D04H 1/732*** | (2012.01) |
| ***D21F 9/02*** | (2006.01) |
| ***D01G 25/00*** | (2006.01) |

(52) U.S. Cl.

CPC ..... *B65H 20/02* (2013.01); *B65H 20/06* (2013.01); *B65H 23/02* (2013.01); *D01G 25/00* (2013.01); *D04H 1/732* (2013.01); *D21F 9/02* (2013.01)

(58) Field of Classification Search

USPC ..... 162/289, 261, 314, 315, 348

See application file for complete search history.

(56) References Cited

U.S. PATENT DOCUMENTS

| | | | | |
|---|---|---|---|---|
| 3,010,161 | A | 11/1961 | Duvall | |
| 4,352,649 | A * | 10/1982 | Jacobsen | D04H 1/736 19/296 |
| 4,640,810 | A * | 2/1987 | Laursen | D04H 1/732 264/121 |
| 2003/0010683 | A1 | 1/2003 | Christensen | |
| 2014/0027075 | A1 | 1/2014 | Yamagami et al. | |
| 2014/0374047 | A1 | 12/2014 | Yamagami | |

FOREIGN PATENT DOCUMENTS

| | | |
|---|---|---|
| JP | 2003-520912 A | 7/2003 |
| JP | 2012-144819 A | 8/2012 |
| JP | 2015-120998 A | 7/2015 |
| JP | 2015-120999 A | 7/2015 |

OTHER PUBLICATIONS

Definition of cover, bing.com, [online], retrieved from the Internet, [retrieved Apr. 15, 2017], <URL: http://www.bing.com/search?q=cover&src=IE-SearchBox&FORM=IESR02>.*

* cited by examiner

*Primary Examiner* — Dennis Cordray

(74) *Attorney, Agent, or Firm* — Global IP Counselors, LLP

(57) ABSTRACT

A sheet manufacturing apparatus includes a drum unit having a plurality of openings, a housing unit covering the drum unit, a transport unit on which a material containing fibers passing through the openings is accumulated as a web and which transports the accumulated web, a first roller that abuts the web transported by the transport unit, and a first seal unit that is provided on a first side wall of the housing unit and comes into contact with the first roller.

7 Claims, 8 Drawing Sheets

SHEET MANUFACTURING APPARATUS

BACKGROUND

1. Technical Field

The present invention relates to a sheet manufacturing apparatus.

2. Related Art

In the related art, a paper recycling apparatus having a dry type defibrating unit that defibrates papers by grinding papers, a first transport unit that transports a defibrated material defibrated by the dry type defibrating unit, a classifying unit that deinks the defibrated material by classifying the defibrated material transported by the first transport unit using airflow, a second transport unit that transports the defibrated material deinked by the classifying unit, and a paper forming unit that forms paper in the defibrated material transported in the second transport unit has been known. Then, it is configured such that the paper forming unit includes a forming drum having a small hole screen configured of a plurality of small holes, fibers are ejected from the small hole screen by driving the forming drum to rotate, and ejected fibers are accumulated on a mesh belt (for example, JP-A-2012-144819).

It is preferable that a configuration, in which fine powder of the fibers and the like is not scattered from between a housing covering the forming drum and a mesh belt to the outside when accumulating the fibers ejected from the forming drum on the mesh belt, is provided.

SUMMARY

The invention can be realized in the following aspects or application examples.

Application Example 1

According to this application example, there is provided a sheet manufacturing apparatus including a drum unit having a plurality of openings; a housing unit covering the drum unit; a transport unit on which a material containing fibers passing through the openings is accumulated as a web and which transports the accumulated web; a first roller that abuts the web transported by the transport unit; and a first seal unit that is provided on a first side wall (first side surface) of the housing unit and comes into contact with the first roller.

In this case, it is possible to prevent the material passing through the openings of the drum unit from scattering to the outside of the housing unit by the first roller and the first seal unit. Furthermore, since the web abuts the first roller, it is possible to stably transport the web.

Application Example 2

In the sheet manufacturing apparatus according to the above application example, a peripheral speed of the first roller may be faster than a transport speed (moving speed) of the web by the transport unit.

In this case, the web is easily pulled in the transport direction by rotation of the first roller. Thus, the material is not retained in the first roller portion. That is, it is possible to prevent the web from jumping and the like and to stably transport the web. Furthermore, it is possible to prevent the web from tearing and the like.

Application Example 3

The sheet manufacturing apparatus according to the above application example may further include a second roller that is positioned further on an upstream side than the first roller in a transport direction of the web; and a second seal unit that is provided on a second side wall (second side surface) facing the first side wall (first side surface) of the housing unit and comes into contact with the second roller.

For example, when it is a configuration in which the second seal unit directly abuts the transport unit, the material adhered to the transport unit is accumulated in the second seal unit and may adversely affect the transport of the transport unit. Furthermore, the material accumulated in the second seal unit becomes a lump and when the lump passes through the second seal unit, the lump joins the web accumulated within the housing unit and quality of a sheet is lowered. On the other hand, according to the configuration of Application Example 3, since the second roller directly abuts the transport unit, it is possible to prevent the material from accumulating in the second seal unit. Furthermore, since material accumulation and the occurrence of the lump are reduced, a cleaning mechanism of the transport unit and the like are omitted.

Application Example 4

In the sheet manufacturing apparatus according to the above application example, the transport unit may include a belt that transports the web, and the apparatus may further include a first belt support plate that faces the first roller to interpose the belt therebetween.

In this case, since a load of the first roller is supported by the first belt support plate, a position of the belt is regulated. Thus, the first roller and the first seal unit are reliably sealed without separating therebetween. Hence, it is possible to prevent the material from scattering to the outside of the housing.

Application Example 5

In the sheet manufacturing apparatus according to the above application example, the transport unit may include a belt that transports the web, and the apparatus may further include a second belt support plate that faces the second roller to interpose the belt therebetween.

In this case, since a load of the second roller is supported by the second belt support plate, the position of the belt is regulated. Thus, the second roller and the second seal unit are reliably sealed without separating therebetween. Hence, it is possible to prevent the material from scattering to the outside of the housing.

Application Example 6

In the sheet manufacturing apparatus according to the above application example, the transport unit may include a belt that transports the web, and the apparatus may further include a third roller that faces the first roller to interpose the belt therebetween.

In this case, since the load of the first roller is supported by the third roller, the position of the belt is regulated. Thus, the first roller and the first seal unit are reliably sealed without separating therebetween. Hence, it is possible to prevent the material from scattering to the outside of the housing. Furthermore, fine powder of the web and the like are unlikely to accumulate between the belt and the third roller, and it is possible to reduce the occurrence of damage of the belt and the like.

Application Example 7

In the sheet manufacturing apparatus according to the above application example, the transport unit may include a belt that transports the web, and the apparatus may further include a fourth roller that faces the second roller to interpose the belt therebetween.

In this case, since the load of the second roller is supported by the fourth roller, the position of the belt is regulated. Thus, the second roller and the second seal unit are reliably sealed without separating therebetween. Hence, it is possible to prevent the material from scattering to the outside of the housing. Furthermore, fine powder of the web and the like is unlikely to accumulate between the belt and the fourth roller, and it is possible to reduce the occurrence of damage of the belt and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, first and second embodiments of the invention will be described with reference to the drawings. Moreover, in each view below, scales of each member and the like are illustrated different from real scales to make each member and the like be recognizable sizes.

First Embodiment

First, a configuration of a sheet manufacturing apparatus will be described. The sheet manufacturing apparatus is, for example, based on a technique of forming a new sheet Pr from a raw material (material to be defibrated) Pu such as pure pulp sheets and used paper. The sheet manufacturing apparatus according to the embodiment includes a drum unit having a plurality of openings, a housing unit covering the drum unit, a transport unit on which a material containing fibers passing through the openings is accumulated as a web and which transports the accumulated web, a first roller that abuts the web transported by the transport unit, and a first seal unit that is provided on a first side surface of the housing unit and comes into contact with the first roller. Hereinafter, the detailed configuration of the sheet manufacturing apparatus will be described.

Figure 1:
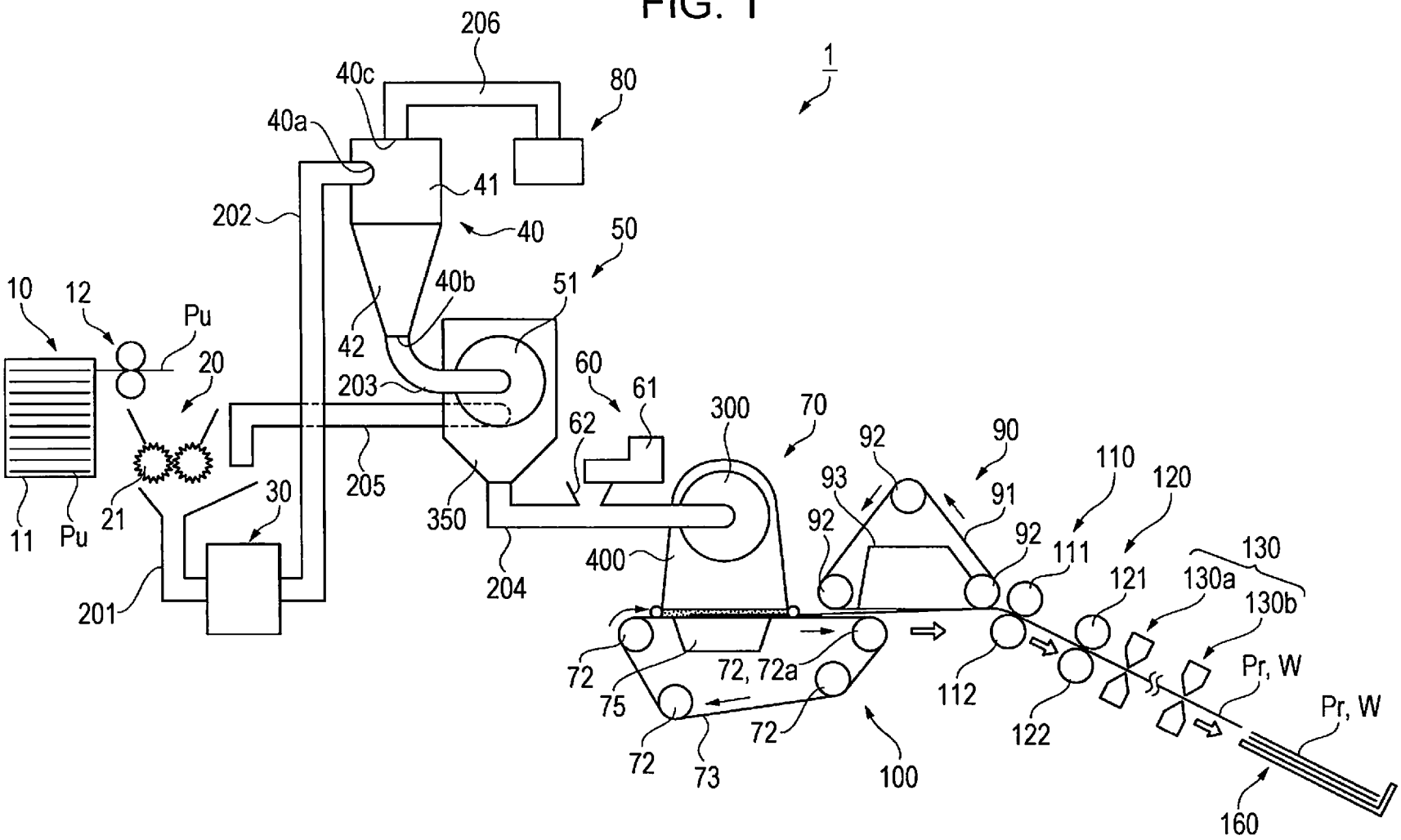
FIG. 1 is a schematic view illustrating a configuration of a sheet manufacturing apparatus according to a first embodiment.

FIG. 1 is a schematic view illustrating the configuration of the sheet manufacturing apparatus according to the embodiment. As illustrated in FIG. 1, a sheet manufacturing apparatus 1 of the embodiment includes a supply unit 10, a crushing unit 20, a defibrating unit 30, a classifying unit 40, a sorting unit 50, an additive feeding unit 60, an accumulation unit 70, a transport unit 100, a heating unit 120, and the like.

The supply unit 10 is provided for supplying a used paper Pu as the raw material to the crushing unit 20. The supply unit 10 includes, for example, a tray 11 in which a plurality of used papers Pu are overlapped and stored, an automatic feeding mechanism 12 capable of continuously feeding the used papers Pu in the tray 11 into the crushing unit 20, and the like. The used paper Pu supplied to the sheet manufacturing apparatus 1 is, for example, paper of A4 size and the like mainly used in an office.

The crushing unit 20 cuts supplied used paper Pu to paper pieces of several centimeters square. The crushing unit 20 includes crushing blades 21 and configures a device for spreading cut widths of blades of a conventional shredder. Thus, it is possible to easily cut the supplied used paper Pu to the paper pieces. Then, cut paper pieces (crushed papers) are supplied to the defibrating unit 30 through a pipe 201.

The defibrating unit 30 defibrates a material containing fibers in the atmosphere. Specifically, the defibrating unit 30 includes rotating rotary blades (not illustrated) and performs defibration to untangle the crushed papers supplied from the crushing unit 20 in fibriform. In the present application, what is defibrated by the defibrating unit 30 is referred to as the material to be defibrated and what passes through the defibrating unit 30 is referred to as the defibrated material. Moreover, the defibrating unit 30 of the embodiment is a dry type and performs defibration in the atmosphere. Coating materials (for example, blur-preventing agent) to the paper such as ink and toner, and the like to be printed are separated from the fiber by being particles (hereinafter, referred to as "ink particles") of several tens of μm or less by the defibrating process of the defibrating unit 30. Thus, the defibrated material drawn out from the defibrating unit 30 is fiber and the ink particles obtained by defibration of the paper pieces. Then, a mechanism of generating airflow by rotation of the rotary blades is provided and the defibrated fiber is transported to the classifying unit 40 in the atmosphere through a pipe 202 by riding on the airflow. Moreover, an airflow generating device for generating the airflow to transport the defibrated fiber to the classifying unit 40 through the pipe 202 may be separately provided in the defibrating unit 30 when required.

The classifying unit 40 classifies an introduced material that is introduced by the airflow. In the embodiment, the defibrated material as the introduced material is classified into the ink particles and the fiber. The classifying unit 40 can classify the transported defibrated material into the ink particles and the fiber by using the airflow, for example, by applying a cyclone. Moreover, another airflow type classifier may be used instead of the cyclone. In this case, as the airflow type classifier other than the cyclone, for example, elbow jet, eddy classifier, and the like are used. The airflow type classifier generates a whirling airflow, separates, and classifies the defibrated material by a difference in a centrifugal force received by a size and density of the defibrated material. Thus, it is possible to adjust a classification point by adjusting a speed of the airflow and the centrifugal force. Thus, the defibrated material is separated into small ink particles of relatively low density and the fiber of high density having particles greater than the ink particles in size.

The classifying unit 40 of the embodiment is a tangent input type cyclone and is configured of an inlet 40*a* through which the introduced material is introduced from the defibrating unit 30, a cylindrical unit 41 to which the inlet 40*a* is attached in a tangent direction, a conical unit 42 following a lower portion of the cylindrical unit 41, a lower outlet 40*b* provided in a lower portion of the conical unit 42, and an upper air outlet 40*c* for discharging fine powder provided in an upper center of the cylindrical unit 41. A diameter of the conical unit 42 is decreased doing downward in a vertical direction.

In a classifying process, the airflow, on which the defibrated material introduced from the inlet 40*a* of the classifying unit 40 rides, is changed to a circumferential movement in the cylindrical unit 41 and the conical unit 42, and the defibrated material is classified by applying the centrifugal force. Then, the fiber that is greater than the ink particles in size and has a high density moves to the lower outlet 40*b* and the ink particles that are relatively small and have a low density are guided to the upper air outlet 40*c* as fine powder together with air. Then, the ink particles are discharged from the upper air outlet 40*c* of the classifying unit 40. Then, the discharged ink particles are recovered in a receiving unit 80 through a pipe 206 connected to the upper air outlet 40*c* of the classifying unit 40. On the other hand, a classified material containing the classified fiber is transported from the lower outlet 40*b* of the classifying unit 40 to the sorting unit 50 through a pipe 203 in the atmosphere. The classified material may be transported from the classifying unit 40 to the sorting unit 50 by the airflow when being classified or may be transported from the classifying unit 40 that is present in an upper portion to the sorting unit 50 that is present in a lower portion by gravity. Moreover, a suction unit for efficiently suctioning a short fiber mixture from the upper air outlet 40*c* and the like may be provided in the upper air outlet 40*c* of the classifying unit 40, the pipe 206, and the like. Classification is not intended to accurately divide the defibrated material by a certain size and density as a boundary. Furthermore, classification is not intended to accurately divide the defibrated material into the fiber and the ink particles. The relatively short fiber in the fibers is discharged from the upper air outlet 40*c* together with the ink particles. The relatively large fiber in the ink particles is discharged from the lower outlet 40*b* together with the fiber.

The sorting unit 50 sorts the classified material (defibrated material) containing the fibers that is classified by the classifying unit 40 by passing through a sieve unit 51 having a plurality of openings. Specifically, the classified material containing the fibers that is classified by the classifying unit 40 is sorted into a passed material that passes through the opening of the sieve unit 51 and a remaining material that does not pass through the opening of the sieve unit 51. The sorting unit 50 of the embodiment includes a mechanism of dispersing the classified material in the air by a rotating motion. Then, the material passing through the opening by sorting of the sorting unit 50 is transported from a passed material transport unit 350 on the accumulation unit 70 side through a pipe 204. On the other hand, the remaining material that does not pass through the opening by sorting of the sorting unit 50 is returned again to the defibrating unit 30 through a pipe 205 as the material to be defibrated. Thus, the remaining material is re-used (recycled) without being discarded.

The material passing through the opening by sorting of the sorting unit 50 is transported to the accumulation unit 70 through the pipe 204 in the atmosphere. The passed material is transported from the sorting unit 50 to the accumulation unit 70 by airflow generating by the blower (not illustrated). Moreover, the passed material may be transported from the sorting unit 50 that is present in the upper portion to the accumulation unit 70 that is present the lower portion by gravity. The additive feeding unit 60 for adding additives such as binding resin (for example, thermoplastic resin or thermosetting resin) and the like to the transported passed material is provided in the pipe 204 between the sorting unit 50 and the accumulation unit 70. Moreover, as the additives, for example, flame retardant, whiteness enhancer, a sheet strength enhancing agent, a sizing agent, an absorption modifier, fragrance, deodorant, and the like may also be fed in addition to the binding resin. The additives are stored in an additive reservoir 61 and are fed from a feeding port 62 by a feeding mechanism (not illustrated).

The accumulation unit 70 accumulates at least a part of the defibrated material that is defibrated by the defibrating unit 30 in the atmosphere. Specifically, the accumulation unit 70 has a mechanism of uniformly dispersing the fibers in the atmosphere and the transport unit 100 that accumulates the dispersed fiber as an accumulated material (web W) and transports the accumulated web. The transport unit 100 has a plurality of stretching rollers 72 and an endless mesh belt 73 in which a mesh is formed. The mesh belt 73 is stretched in the stretching rollers 72 and the mesh belt 73 is rotated (moved) in one direction by rotating at least one of the stretching rollers 72. The accumulation unit 70 forms the web W by accumulating the material (mixture) containing the fibers or binding resin fed from the pipe 204 on the mesh belt 73. Moreover, the web W according to the embodiment refers a configuration form of an object containing the fibers and binding resin. Thus, even if a form of the web such as a size is changed when heating, pressing, cutting, transporting of the web and the like, it is represented as the web W.

As a mechanism of uniformly dispersing the fiber in the atmosphere, a drum unit 300 into which the fiber and the binding resin are fed is disposed in the accumulation unit 70. Then, it is possible to uniformly mix the binding resin (additive) in the passed material (fiber) by driving the drum unit 300 to rotate. A screen (opening unit) having a plurality of small holes (openings) is provided in the drum unit 300. Then, it is possible to uniformly mix the binding resin (additives) in the passed material (fiber) by driving the drum unit 300 to rotate. Then, binding resin (additive) in the passed material (fiber) is uniformly mixed and it is possible to uniformly disperse the fibers or the mixture of the fibers and binding resin passing through the small holes in the atmosphere by driving the drum unit 300 to rotate.

The mesh belt 73 (belt) that is a part of the transport unit 100 is disposed below the drum unit 300. Furthermore, a suction device 75 as the suction unit generating the airflow vertically downward (from the drum unit 300 to the mesh belt 73) through the mesh belt 73 is provided vertically below the drum unit 300. It is possible to suck the fibers (mixtures) dispersed in the atmosphere on the mesh belt 73 by the suction device 75.

Then, the fiber and the like passing through the small hole screen of the drum unit 300 are accumulated on the mesh belt 73 by assisting of a suction force by the suction device 75. In this case, it is possible to form an accumulated material (web W) of an elongated shape containing the fiber and the binding resin by moving the mesh belt 73 in one direction. The continuous strip-shaped continuous web W is formed by continuously performing dispersion from the drum unit 300 and moving of the mesh belt 73. Moreover, the mesh belt 73 may be made of metal, resin, and nonwoven fabric, and may be any one as long as the fiber can be accumulated and the airflow can be passed through. Moreover, if a hole diameter of the mesh of the mesh belt 73 is too large, the fiber enters between the meshes and becomes uneven when forming the web W (sheet), on the other hand, if the hole diameter of the mesh is too small, a stable airflow by the suction device 75 is difficult to form. Thus, it is preferable that the hole diameter of the mesh is appropriately adjusted (set). The suction device 75 can be configured by disposing a closed box (box) having a window of a desired size opened under the mesh belt 73, suctioning air from the outside of the window, and making the inside of the box be a negative pressure.

The web W formed on the mesh belt 73 is transported in a transport direction (white arrows in the view) by rotation of the mesh belt 73. An intermediate transport unit 90 is disposed on an upper side of the mesh belt 73 as a release unit. The web W is released from the mesh belt 73 by the intermediate transport unit 90 and is transported on a pressing unit 110 side. The intermediate transport unit 90 is configured so as to transport the web W while suctioning the web W vertically upward (direction separating the web W from the mesh belt 73). The intermediate transport unit 90 is disposed by being separated from the mesh belt 73 vertically upward (direction perpendicular to a surface of the web W) and a part of the intermediate transport unit 90 is disposed to be shifted to the mesh belt 73 on a downstream side in the transport direction of the web W. Then, a transporting section of the intermediate transport unit 90 is a section from a stretching roller 72*a* on the downstream side of the mesh belt 73 to the pressing unit 110.

The intermediate transport unit 90 has a transport belt 91, a plurality of stretching rollers 92, and a suction chamber 93. The transport belt 91 is an endless mesh belt in which the mesh is formed and which is stretched by the stretching rollers 92. Then, the transport belt 91 is rotated (moves) in one direction by rotating at least one of the plurality of stretching rollers 92.

The suction chamber 93 is disposed on an inside of the transport belt 91 and has a hollow box shape having an upper surface and four side surfaces coming into contact with the upper surface, and of which a bottom surface (surface facing the transport belt 91 positioned below) is opened. Furthermore, the suction chamber 93 includes a suction unit generating the airflow (suction force) into the suction chamber 93. Then, an inner space of the suction chamber 93 is suctioned and air flows from the bottom surface of the suction chamber 93 by driving the suction unit. Thus, the airflow is generated upward on the inside of the suction chamber 93, the web W is suctioned from above, and the web W can be suctioned to the transport belt 91. Then, the transport belt 91 is moved (circulated) by rotating the stretching rollers 92 and can transport the web W to the pressing unit 110. Furthermore, the suction chamber 93 overlaps a part of the mesh belt 73 when viewed from above and is disposed in a position on the downstream side where the suction device 75 does not overlap. Thus, the web W on the mesh belt 73 is released from the mesh belt 73 in a position facing the suction chamber 93 and can be suctioned to the transport belt 91. The stretching rollers 92 rotate such that the transport belt 91 moves at the same speed as that of the mesh belt 73. If there is a difference in the speeds of the mesh belt 73 and the transport belt 91, it is possible to prevent that the web W is broken or buckled by being pulled by making the speed thereof be the same speed.

The pressing unit 110 is provided to press the web W as the accumulated material that is accumulated by the accumulation unit 70. The pressing unit 110 is configured of a pair of pressing rollers 111 and 112, and initially presses the web W. That is, the sheet manufacturing apparatus 1 has a configuration which does not have another pressing unit (for example, another pair of pressing rollers) for pressing the web W formed between the accumulation unit 70 and the pressing unit 110 by the accumulation unit 70. Moreover, the pressing unit 110 of the embodiment presses the web W so as to be the web W of a thickness of approximately 1/5 to 1/30 of the thickness of the web W formed by the accumulation unit 70. Thus, a configuration, in which a single roller, the transfer belt, and the like are disposed between the accumulation unit 70 and the pressing unit 110 for simply transporting the web W, may be provided. Furthermore, a configuration, in which rollers (pair of rollers) finely pressing (pressure of an extent not beyond a pressure to be the above described thickness of the web W) the web W is disposed, may be provided. Then, the pressing unit 110 presses the web W transported by the intermediate transport unit 90 by interposing the web W between the pair of pressing rollers 111 and 112. Thus, it is possible to enhance the strength of the web W by pressing the web W. Moreover, a detailed configuration of the pressing unit 110 will be described below.

The heating unit 120 is disposed on a downstream side of the pressing unit 110 in the transport direction. The heating unit 120 is provided to bind the fibers containing the web W through the binding resin. The heating unit 120 of the embodiment is configured of a pair of heating rollers 121 and 122. A heating member (heating source) such as a heater is provided in a center portion of rotary shafts of the heating rollers 121 and 122, and it is possible to heat and press the web W by transporting the web W by pinching the web W by the pair of heating rollers 121 and 122. The web W is heated and pressed and thereby the binding resin is easily entangled with the fiber by being melted, fiber intervals between the fibers are shortened, and contact points between the fibers are increased. Thus, the strength is enhanced as the web W having high density.

As the cutting unit 130 cutting the web W, a first cutting unit 130*a* cutting the web W in a direction intersecting the transport direction of the web W and a second cutting unit 130*b* cutting the web W along the transport direction of the web W are disposed on the downstream side of the heating unit 120 in the transport direction. The first cutting unit 130*a* includes a cutter and cuts the continuous web W in a sheet form according to a cutting position that is set in a predetermined length. The second cutting unit 130*b* has a cutter and cuts the web W according to a predetermined cutting position in the transport direction of the web W. Thus, the sheet Pr (web W) of a desired size is formed. The cut sheets Pr are stacked on a stacker 160 and the like. Moreover, it may be configured so as to wind the continuous web W by a winding roller in a roll shape by a winding roller without cutting the web W. As described above, it is possible to manufacture the sheet Pr in the sheet manufacturing apparatus 1.

Moreover, the sheet according to the embodiment mainly refers to that formed in a sheet shape, which contains the fiber such as the used paper and the pure pulp as the raw material. However, the sheet is not limited to the embodiment and may be a board shape or a web shape (or a shape having unevenness). Furthermore, as the raw material, plant fibers such as cellulose, chemical fibers such as polyethylene terephthalate (PET) and polyester, and animal fibers such as wool and silk may be included. The sheet in the present application is divided into paper and non-woven fabric. Paper includes aspects formed in a thin sheet shape and includes recording paper for writing or printing, wallpaper, wrapping paper, colored paper, Kent paper, and the like. Non-woven fabric has a thickness thicker than that of paper or has a strength lower than that of paper, and includes non-woven fabric, fiber board, tissue paper, kitchen paper, cleaner, filter, liquid absorption material, sound-absorbing material, cushioning material, mat, and the like.

Furthermore, the used paper in the embodiment described above mainly refers to printed paper and it is assumed as the used paper regardless of whether or not the paper is used as long as paper is formed as the raw material.

Figure 2A:
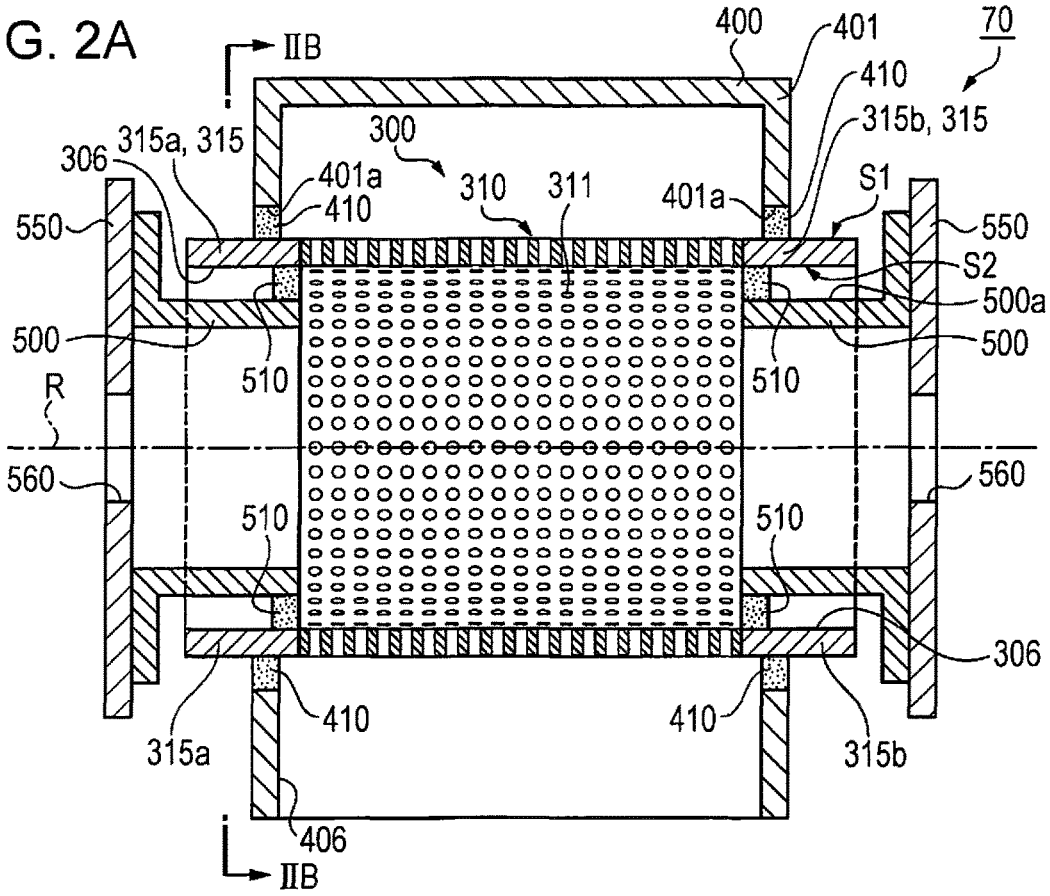
FIG. 2A is a schematic view illustrating a configuration of an accumulation unit according to the first embodiment and a sectional view in a rotational axis direction.
Figure 2B:
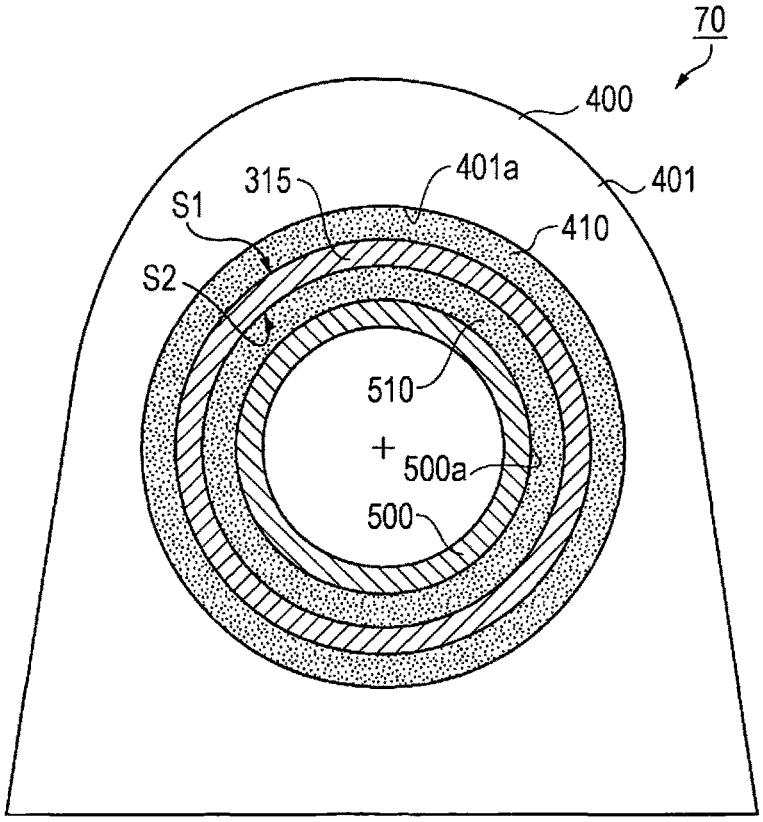
FIG. 2B is a schematic view illustrating a configuration of the accumulation unit according to the first embodiment and a sectional view that is taken along line IIB-IIB in FIG. 2A.
Figure 3:
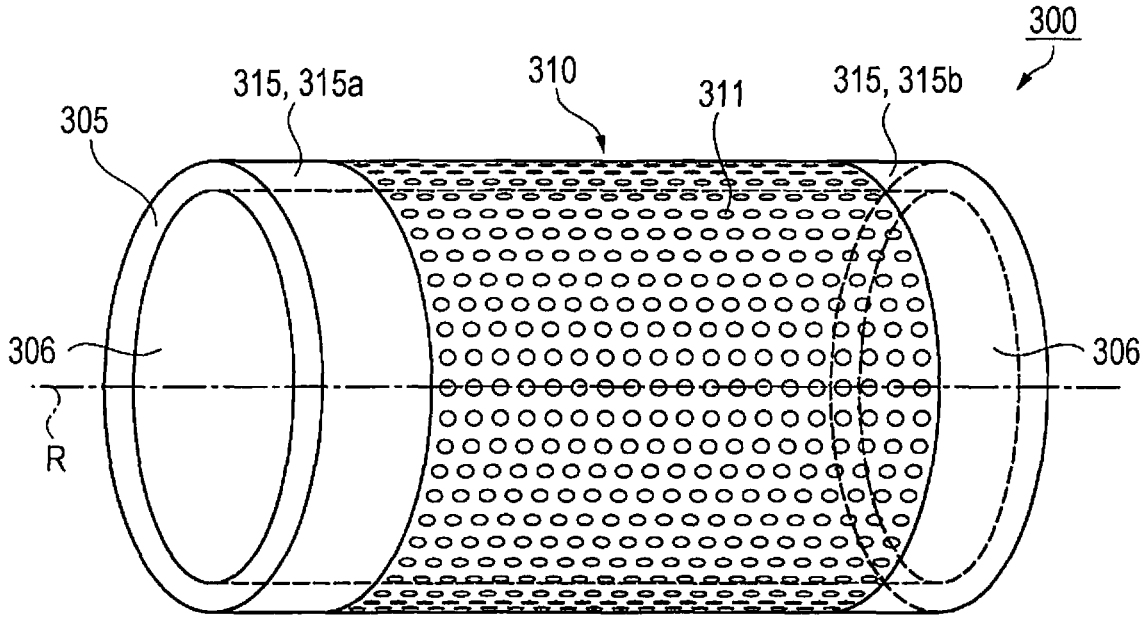
FIG. 3 is a perspective view illustrating a configuration of a drum unit according to the first embodiment.
Figure 4A:
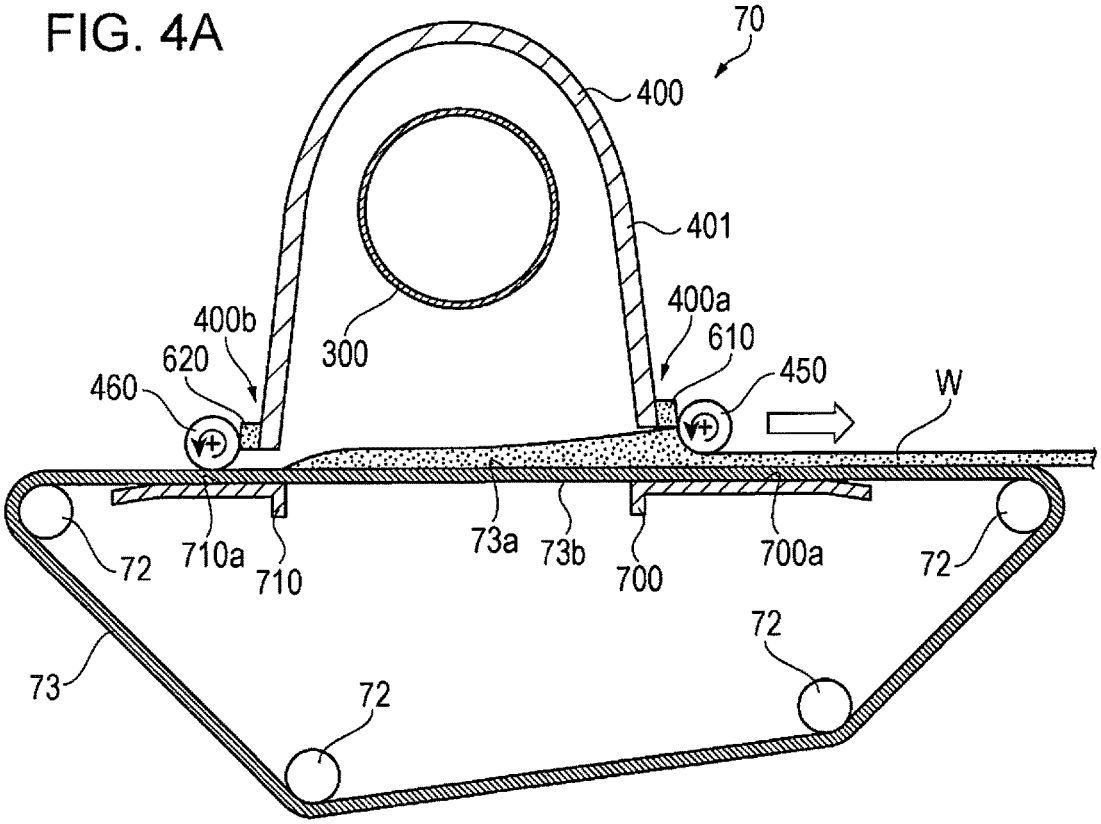
FIG. 4A is a schematic view illustrating configurations of the accumulation unit and a periphery thereof according to the first embodiment and a sectional view including the accumulation unit and a mesh belt.
Figure 4B:
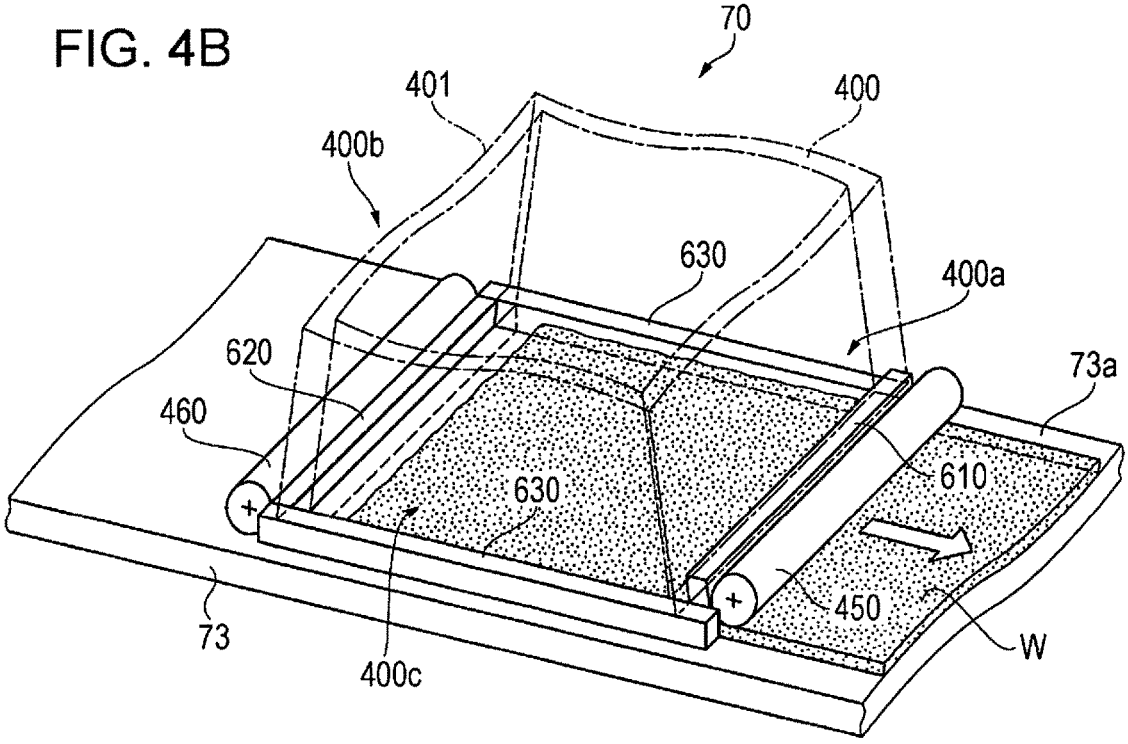
FIG. 4B is a schematic view illustrating the configuration of the accumulation unit and the periphery thereof according to the first embodiment and is a perspective view including the accumulation unit and the mesh belt.

Next, a detailed configuration of the accumulation unit 70 will be described. FIGS. 2A and 2B are schematic views illustrating the configuration of the accumulation unit, FIG. 2A is a sectional view in a rotation axis direction, and FIG. 2B is a sectional view that is taken along line IIB-IIB in FIG. 2A. Furthermore, FIG. 3 is a perspective view illustrating a configuration of the drum unit. FIGS. 4A and 4B are schematic views illustrating configurations of the accumulation unit and a periphery thereof, FIG. 4A is a sectional view including the accumulation unit and the mesh belt, and FIG. 4B is a perspective view including the accumulation unit and the mesh belt. Moreover, in FIGS. 4A and 4B, the suction device 75 and the intermediate transport unit 90 are omitted.

As illustrated in FIGS. 2A and 2B, the accumulation unit 70 includes the drum unit 300, the housing unit 400, and the like.

The drum unit 300 has a rotatable cylindrical unit 305 and as illustrated in FIG. 3, the cylindrical unit 305 has an opening unit 310 having a plurality of openings 311 and a tubular unit 315 having no opening 311. The opening unit 310 and the tubular unit 315 are coupled, for example, by welding or screws, and are integrally rotated. The cylindrical unit 305 is formed in a cylindrical shape by using a metal plate such as stainless steel having a uniform thickness and opening ports 306 are provided both ends thereof.

The opening unit 310 is configured of a punched metal in which the plurality of openings 311 are provided. The opening unit 310 is configured such that the material containing the fibers passes through the openings 311 and is dispersed. A size, a forming region of the openings 311, and the like are appropriately set by a size and a type of the material, and the like. Moreover, the opening unit 310 is not limited to the punched metal and may be a wire mesh material and the like. The plurality of openings 311 are disposed in the same size (area) respectively at equal intervals. Thus, the material passing through the openings 311 is accumulated on the mesh belt 73 with uniform thickness and density. Furthermore, when passing through the openings 311, the entangled fibers are loosened. The tubular unit 315 is a portion does not have the opening 311 and the like and is a portion coming into contact with the housing unit 400.

The housing unit 400 surrounds a periphery of the drum unit 300 and as illustrated in FIGS. 2A and 2B, has a frame 401 of which a plurality of wall surfaces are bonded, and has a space unit on an inside thereof. A lower portion of the housing unit 400 is not a wall surface and an opening 406 is provided. Furthermore, the housing unit 400 has frame bonding surfaces 401*a* that are circular openings on two wall surfaces (side walls 400*c* which will be described below) facing in the rotation axis direction R of the drum unit 300 and pile seal units 410 described below are bonded to the frame bonding surfaces 401*a*. The housing unit 400 does not have openings other than the opening 406 and the frame bonding surface 401*a*. The housing unit 400 surrounds the drum unit 300 such that the opening unit 310 of the drum unit 300 comes on an inside thereof. That is, the opening unit 310 of the drum unit 300 is positioned within a space on the inside of the housing unit 400. Then, the housing unit 400 and the tubular unit 315 come into contact with each other through the pile seal units 410. In the embodiment, as illustrated in FIG. 3, the drum unit 300 has a tubular unit 315*a*, the opening unit 310, and a tubular unit 315*b*, and as illustrated in FIGS. 2A and 2B, the housing unit 400 comes into contact with a surface S1 of the cylindrical unit in the tubular units 315*a* and 315*b*. As described above, the housing unit 400 (pile seal unit 410) comes into contact with the tubular units 315*a* and 315*b* and thereby it is possible to suppress discharge of the material containing the fibers and the like passing through the openings 311 from the inside to the outside of the housing unit 400. Furthermore, the housing unit 400 is disposed on the inside of the drum unit 300 in the rotation axis direction R of the drum unit 300. Thus, a width dimension of the housing unit 400 may be shorter than a width dimension of the drum unit 300 in the rotation axis direction R and it is possible to reduce a size of the apparatus. Moreover, a dimension of the housing unit 400 is greater than an outer diameter dimension of the drum unit 300 in a direction orthogonal to the rotation axis direction R of the drum unit 300 and thereby the drum unit 300 is disposed on an inside of the housing unit 400.

Furthermore, the housing unit 400 of the embodiment has the pile seal unit 410 and the surface S1 of the tubular unit 315 comes into contact with the pile seal unit 410 (sliding contact). The pile seal unit 410 is configured of, for example, a base unit and a plurality of fibers that are densely planted on one surface side of the base unit. The pile seal unit 410 has the plurality of fibers (pile yarns) which are densely planted to an extent that the fibers passing through the openings 311 of the drum unit 300 cannot pass through the plurality of fibers. Then, it is configured such that the other surface of the base unit of the pile seal unit 410 is bonded to the frame bonding surface 401*a* of the housing unit 400 and tip end portions of the fibers of the pile seal unit 410 come into contact with the surface S1 of the tubular unit 315. The openings 311 are not formed on the surface S1 of the tubular unit 315 coming into contact with the pile seal unit 410. Furthermore, it is preferable that unevenness is not present at least on the surface S1 coming into contact with the pile seal unit 410. Thus, a gap between the frame 401 of the housing unit 400 and the tubular unit 315 of the drum unit 300 is substantially closed by the pile seal unit 410. Thus, the material containing the fibers and the like passing through the openings 311 of the drum unit 300 are held on the inside of the housing unit 400 and it is possible to suppress discharge of the material to the outside of the housing unit 400. Furthermore, it is possible to suppress entry of foreign materials from the outside of the housing unit 400. Furthermore, when the drum unit 300 is rotated about the rotation axis direction R, wear in a sliding portion, where the tubular unit 315 and the pile seal unit 410 are rubbed, is suppressed and it is possible to reduce a rotational load of the drum unit 300. Moreover, the length of the fiber of the pile seal unit 410 is set to be longer than the gap between the frame 401 of the housing unit 400 and the tubular unit 315 of the drum unit 300. It is because the pile seal unit 410 reliably comes into contact with the tubular unit 315. Moreover, the pile seal unit 410 may be provided in the tubular unit 315. However, in this case, the drum unit 300 is shifted to the housing unit 400 in an extending direction of the rotation axis direction R, there is a concern that a contact area between the pile seal unit 410 and the frame 401 is reduced. Thus, it is preferable that the pile seal unit 410 is provided in the housing unit 400 and comes into contact with the tubular unit 315 greater than (width is wider) the pile seal unit 410 in the extending direction of the rotation axis direction R.

Furthermore, in the embodiment, as illustrated in FIGS. 2A and 2B, flange units 500 are provided on the inside of the tubular unit 315 of the drum unit 300 and the tubular unit 315 comes into contact with the flange units 500 through pile seal units 510. In the embodiment, the flange units 500 are disposed on insides of both tubular units 315*a* and 315*b* of the drum unit 300. The flange units 500 are fixed to flange fixing plates 550. Then, the flange fixing plates 550 are fixed to outer frames (not illustrated). Material supply ports 560 are provided in the flange fixing plates 550 for supply the material containing the fibers to the inside of the drum unit 300.

The pile seal unit 510 is provided between a rear surface S2 of the tubular unit 315 and a surface 500*a* of the flange unit 500. The pile seal unit 510 is configured of, for example, a base unit and a plurality of fibers that are densely planted on one surface side of the base unit. The pile seal unit 510 has the plurality of fibers which are densely planted to an extent that the material containing the fibers cannot pass through the plurality of fibers. Then, in the embodiment, it is configured such that the other surface of the base unit of the pile seal unit 510 is bonded to the surface 500*a* of the flange unit 500 and tip end portions of the fibers of the pile seal unit 510 come into contact with the rear surface S2 of the tubular unit 315. Thus, a gap between the flange unit 500 and the tubular unit 315 of the drum unit 300 is substantially closed by the pile seal unit 510. Thus, it is possible to suppress discharge of the material containing the fibers to the outside from the gap between the tubular unit 315 and the flange unit 500. Furthermore, it is possible to suppress entry of foreign materials from the outside of the flange unit 500. Furthermore, since the drum unit 300 is rotated about the rotation axis R, wear in a sliding portion, where the tubular unit 315 and the pile seal unit 510 are rubbed, is suppressed and it is possible to reduce the rotational load of the drum unit 300. Moreover, the length of the fiber of the pile seal unit 510 is, for example, set to be longer than the gap between the flange unit 500 and the tubular unit 315 of the drum unit 300. It is because the pile seal unit 510 reliably comes into contact with the tubular unit 315. Since the pile seal unit 510 is bonded to the flange unit 500, the flange unit 500 can be said to have the pile seal unit 510. Moreover, the pile seal unit 510 may be bonded to the tubular unit 315. Moreover, the drum unit 300 is supported by a support unit (not illustrated) and a weight of the drum unit 300 is not applied to the pile seal units 410 and 510.

Furthermore, as illustrated in FIG. 4A, a first roller 450 abutting the web W transported by the mesh belt 73 is provided on the downstream side of the transport direction of the web W with respect to the housing unit 400. Furthermore, a first seal unit 610 coming into contact with the first roller 450 is provided on a first side wall (first side surface) 400*a* of the housing unit 400. Moreover, the first side wall 400*a* includes an outer surface, an inner surface, and an end surface (surface facing the mesh belt 73). The first seal unit 610 of the embodiment is provided on the outer side surface of the first side wall 400*a*. Then, the first seal unit 610 abuts the first roller 450.

As illustrated in FIG. 4B, the first roller 450 has a rotational axis along a direction (width direction of the web W) intersecting the transport direction of the web W. Furthermore, the first roller 450 has a length equal to a width dimension (width direction of the web W) of the frame 401 of the housing unit 400.

Furthermore, the first roller 450 is connected to a driving unit (not illustrated) such as a motor driving the first roller 450. Then, the first roller 450 can be rotated (counterclockwise direction in FIG. 4A) about the rotational axis by driving the driving unit. A driving speed of the first roller 450 is set to be faster than the transport speed of the web W by the mesh belt 73. That is, a peripheral speed of the first roller 450 is set to be faster than the transport speed (moving speed) of the web W by the mesh belt 73. Thus, the web W is easily pulled in the transport direction, accumulation of the web W within the housing unit 400, occurrence of jumping of the web W, and the like are reduced, and then it is possible to stably transport the web W. Moreover, a rotational shaft of the first roller 450 is set to be positioned in a position that is higher than a top height (thickness) of the web W that is accumulated on the upstream side in the transport direction with respect to the first roller 450. This is because if the rotational shaft of the first roller 450 is positioned in position that is lower than the height of the web W accumulated on the upstream side of the first roller 450 in the transport direction, an upper portion of the accumulated web W is unlikely to transported and the web W is likely to accumulate within the housing unit 400.

Furthermore, the first roller 450 can be moved in up and down directions (direction intersecting an accumulation surface of the mesh belt 73 or the thickness direction of the web W) and is biased by a biasing member (not illustrated) downward (mesh belt 73 side). A first belt support plate 700 is provided in a position facing the first roller 450 to interpose the mesh belt 73 therebetween. The first belt support plate 700 has a flat surface 700*a* and the flat surface 700*a* is fixed and disposed in a position which faces and substantially comes into contact with an inner surface (inner peripheral surface) 73*b* of the mesh belt 73. Thus, the position of the mesh belt 73 is regulated by the first belt support plate 700 and a posture of the accumulation surface of the mesh belt 73 is held substantially in the horizontal direction without falling downward by a pressing pressure of the first roller 450 and gravity. Furthermore, even if a load is applied downward by a biasing force by a biasing member or the gravity, the first roller 450 is supported by the first belt support plate 700 through the mesh belt 73. Thus, the first roller 450 is not separated from the first seal unit 610 and it is possible to maintain a contact state between the first roller 450 and the first seal unit 610. Thus, it is possible to reliably seal between the first side wall 400*a* of the housing unit 400 and the first roller 450. Hence, it is possible to reliably close the inside of the housing unit 400.

The first seal unit 610 is, for example, a pile seal and since a configuration of the pile seal is the same as the configuration of the pile seal units 410 and 510, the description thereof will be omitted. It is configured such that the other surface of a base unit of the first seal unit 610 is bonded to the outer surface of the first side wall 400*a* of the housing unit 400 and tip end portions of the fibers of the first seal unit 610 come into contact with a surface of the first roller 450 (peripheral surface). Thus, occurrence of wear in a sliding portion, where the first roller 450 that is driven to rotate and the first seal unit 610 are rubbed, is suppressed and it is possible to reduce a load to the first roller 450. The length of the fiber of the first seal unit 610 is set such that the first seal unit 610 reliably comes into contact with the first roller 450. For example, the length of the fiber of the first seal unit 610 is set to be longer than a gap between the first side wall 400*a* of the housing unit 400 and the surface of the first roller 450.

Furthermore, a second roller 460 is disposed on further upstream side in the transport direction of the web W than the first roller 450. Furthermore, a second seal unit 620 coming into contact with the second roller 460 is provided on a second side wall (second side surface) 400*b* facing the first side wall 400*a* of the housing unit 400. The second seal unit 620 of the embodiment is provided on an outer surface of the second side wall 400*b*. Moreover, as illustrated in FIG. 4A, in the example, the first side wall 400*a* and the second side wall 400*b* are connected such that a cross section thereof orthogonal to the rotation axis R of the drum unit 300 becomes a U-shape. As described above, the first side wall 400*a* and the second side wall 400*b* may be a one connected wall portion or may be two independent wall portions which are connected to each other by another wall portion.

As illustrated in FIG. 4B, the second roller 460 has a rotational axis along a direction (width direction of the web W) intersecting the transport direction of the web W. Furthermore, the second roller 460 has a length equal to a width dimension (width direction of the web W) of the frame 401 of the housing unit 400.

Furthermore, the second roller 460 is connected to a driving unit (not illustrated) such as a motor driving the second roller 460. Then, it is possible to rotate (counter-clockwise direction in FIG. 4A) the second roller 460 by driving the driving unit about the rotation axis. A driving speed (peripheral speed) of the second roller 460 is set to be equal to the transport speed (moving speed) of the web W by the mesh belt 73. Then, the second roller 460 is disposed so as to come into contact with the outer surface (outer peripheral surface) 73*a* of the mesh belt 73. Here, if the second seal unit 620 is configured to directly come into contact with an outer surface 73*a* of the mesh belt 73, there is a concern that the material attached to the mesh belt 73 is accumulated in the second seal unit 620 and which influences the transport of the mesh belt 73. Furthermore, there is a concern that the material accumulated in the second seal unit 620 becomes a lump, the lump passes through the second seal unit 620 and is merged with the web W accumulated within the housing unit 400, and then quality of the sheet Pr is lowered. Thus, the second roller 460 is disposed so as to come into contact with the outer surface 73*a* of the mesh belt 73 and thereby it is possible to prevent the drawbacks described above.

Furthermore, the second roller 460 can be moved in the up and down directions (direction intersecting the accumulation surface of the mesh belt 73 or the thickness direction of the web W) and is biased downward by a biasing member (not illustrated). A second belt support plate 710 is provided in a position facing the second roller 460 to interpose the mesh belt 73 therebetween. The second belt support plate 710 has a flat surface 710*a* and the flat surface 710*a* is fixed and disposed in a position which faces and substantially comes into contact with the inner surface (inner peripheral surface) 73*b* of the mesh belt 73. Thus, the position of the mesh belt 73 is regulated by the second belt support plate 710 and the posture of the accumulation surface of the mesh belt 73 is held substantially in the horizontal direction without falling downward by a pressing pressure of the second roller 460 and the gravity. Furthermore, even if a load is applied downward by a biasing force by the biasing member or the gravity, the second roller 460 is supported by the second belt support plate 710 through the mesh belt 73. Thus, the second roller 460 is not separated from the second seal unit 620 and it is possible to maintain a contact state between the second roller 460 and the second seal unit 620. Thus, it is possible to reliably seal between the second side wall 410*a* of the housing unit 400 and the second roller 460. Hence, it is possible to reliably close the inside of the housing unit 400.

The second seal unit 620 is, for example, a pile seal and since a configuration of the pile seal is the same as the configuration of the pile seal units 410 and 510, the description thereof will be omitted. It is configured such that the other surface of a base unit of the second seal unit 620 is bonded to the outer surface of the second side wall 400*b* of the housing unit 400 and tip end portions of the fibers of the second seal unit 620 come into contact with a surface of the second roller 460 (peripheral surface). Thus, occurrence of wear in a sliding portion, where the second roller 460 that is driven to rotate and the second seal unit 620 are rubbed, is suppressed and it is possible to reduce a load to the second roller 460. The length of the fiber of the second seal unit 620 is set such that the second seal unit 620 reliably comes into contact with the second roller 460. For example, the length of the fiber of the second seal unit 620 is set to be longer than a gap between the second side wall 400*b* of the housing unit 400 and the surface of the second roller 460.

Furthermore, as illustrated in FIG. 4B, a third seal unit 630 coming into contact with the mesh belt 73 is provided on the side wall (side surface) 400*c* other than the first side wall 400*a* and the second side wall 400*b* of the housing unit 400. The side wall 400*c* is connected to the first side wall 400*a* and the second side wall 400*b*, and in the example, there are two wall portions along (facing in the rotation axis direction R of the drum unit 300) the direction in which the mesh belt 73 is moved. The third seal unit 630 is, for example, a pile seal and since a configuration of the pile seal is the same as the configuration of the pile seal units 410 and 510, the description thereof will be omitted. It is configured such that the other surface of a base unit of the third seal unit 630 is bonded to the side wall 400*c* (peripheral portion (end surface) of the side wall 400*c* in the example) of the housing unit 400 and tip end portions of the fibers of the third seal unit 630 come into contact with the outer surface 73*a* of the mesh belt 73. Wear of the mesh belt 73 and the third seal unit 630 is suppressed and it is possible to reduce a load to the mesh belt 73 when the mesh belt 73 moves with respect to the accumulation unit 70 (housing unit 400). Moreover, a dimension (width dimension) of the mesh belt 73 in a direction orthogonal to the moving direction (transport direction of the web W) of the mesh belt 73 is set to be greater than that of the housing unit 400 and a gap between the housing unit 400 and the mesh belt 73 is not generated.

Above, as illustrated in FIGS. 4A and 4B, four positions of the frame 401 of the housing unit 400 corresponding to the outer surface 73*a* of the mesh belt 73 are substantially closed by the first roller 450, the first seal unit 610, the second roller 460, the second seal unit 620, and the third seal unit 630. Thus, the material containing the fibers and the like passing (before accumulated) through the openings 311 of the drum unit 300 are accumulated on the inside of the housing unit 400 and it is possible to suppress discharge thereof to the outside of the housing unit 400.

According to the first embodiment described above, it is possible to obtain the following effects.

The driving speed of the first roller 450 is set to be faster than the transport speed of the web W. Thus, the web W is easily pulled in the transport direction, accumulation of the web W within the housing unit 400, occurrence of jumping and the like of the web W are reduced, and it is possible to stably transport the web W. Furthermore, the first belt support plate 700 is fixed and disposed in the position facing the first roller 450 to interpose the mesh belt 73 therebetween. Thus, the position of the mesh belt 73 is regulated and it is possible to reliably close the inside of the housing unit 400.

Second Embodiment

Next, a second embodiment will be described. Since a basic configuration of the sheet manufacturing apparatus is the same as that of the first embodiment, description thereof will be omitted. Hereinafter, a configuration different from the first embodiment is described.

Figure 5:
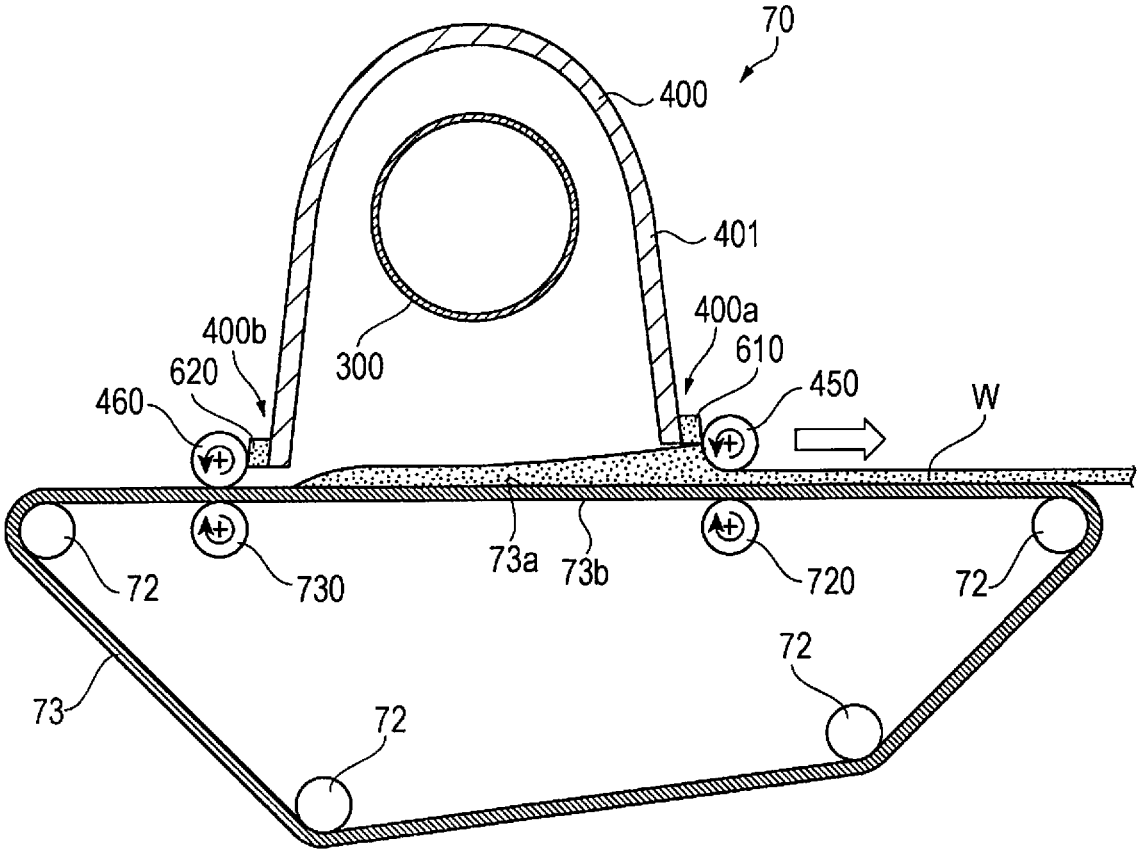
FIG. 5 is a schematic view illustrating configurations of an accumulation unit and a periphery thereof according to a second embodiment.

FIG. 5 is a schematic view illustrating configurations of an accumulation unit and a periphery thereof according to the embodiment. Similar to the first embodiment, as illustrated in FIG. 5, a first roller 450 and a first seal unit 610 coming into contact with the first roller 450 are provided on a downstream side of a housing unit 400 in a transport direction of a web W. Furthermore, a second roller 460 and a second seal unit 620 coming into contact with the second roller 460 are provided on an upstream side of the housing unit 400 in the transport direction of the web W. Since configurations of the first and second rollers 450 and 460, and configurations of the first and second seal units 610 and 620 are the same as those of the first embodiment, description thereof will be omitted.

In the embodiment, a third roller 720 facing the first roller 450 is provided to interpose a mesh belt 73 therebetween. A position of a rotational shaft of the third roller 720 is fixed and disposed so as to come into contact with an inner surface 73*b* of the mesh belt 73. Thus, a position of the mesh belt 73 is regulated by the third roller 720 and a posture of an accumulation surface of the mesh belt 73 is held substantially in the horizontal direction without falling downward by a pressing pressure of the first roller 450 and the gravity.

Similarly, a fourth roller 730 facing the second roller 460 is provided to interpose the mesh belt 73 therebetween. A position of a rotational shaft of the fourth roller 730 is fixed and disposed so as to come into contact with the inner surface 73*b* of the mesh belt 73. Thus, the position of the mesh belt 73 is regulated by the fourth roller 730 and the posture of the accumulation surface of the mesh belt 73 is held substantially in the horizontal direction without falling downward by the pressing pressure of the second roller 460 and the gravity.

Furthermore, a side wall 400*c* of the housing unit 400 has a third seal unit 630 coming into contact with the mesh belt 73 (see FIG. 4B). Since a configuration of the third seal unit 630 is the same as that of the first embodiment, description thereof will be omitted.

Above, according to the second embodiment, it is possible to obtain the following effects.

A contact area between the inner surface 73*b* of the mesh belt 73 and the third roller 720 coming into contact with the mesh belt 73 is small (contact with substantially point contact when viewed in a sectional view in a direction orthogonal to the rotational axis of the third roller 720). Thus, fine powder such as the fibers or resin is unlikely to be accumulated between the mesh belt 73 and the third roller 720. Similarly, fine powder is unlikely to be accumulated between the mesh belt 73 and the fourth roller 730. Thus, it is possible to reduce occurrence of damage of the mesh belt 73 and the like.

The invention is not limited to the embodiments described above and it is possible to adjust various modifications and improvements to the embodiments described above. The modifications are described as follows.

Modification Example 1

Figure 6:
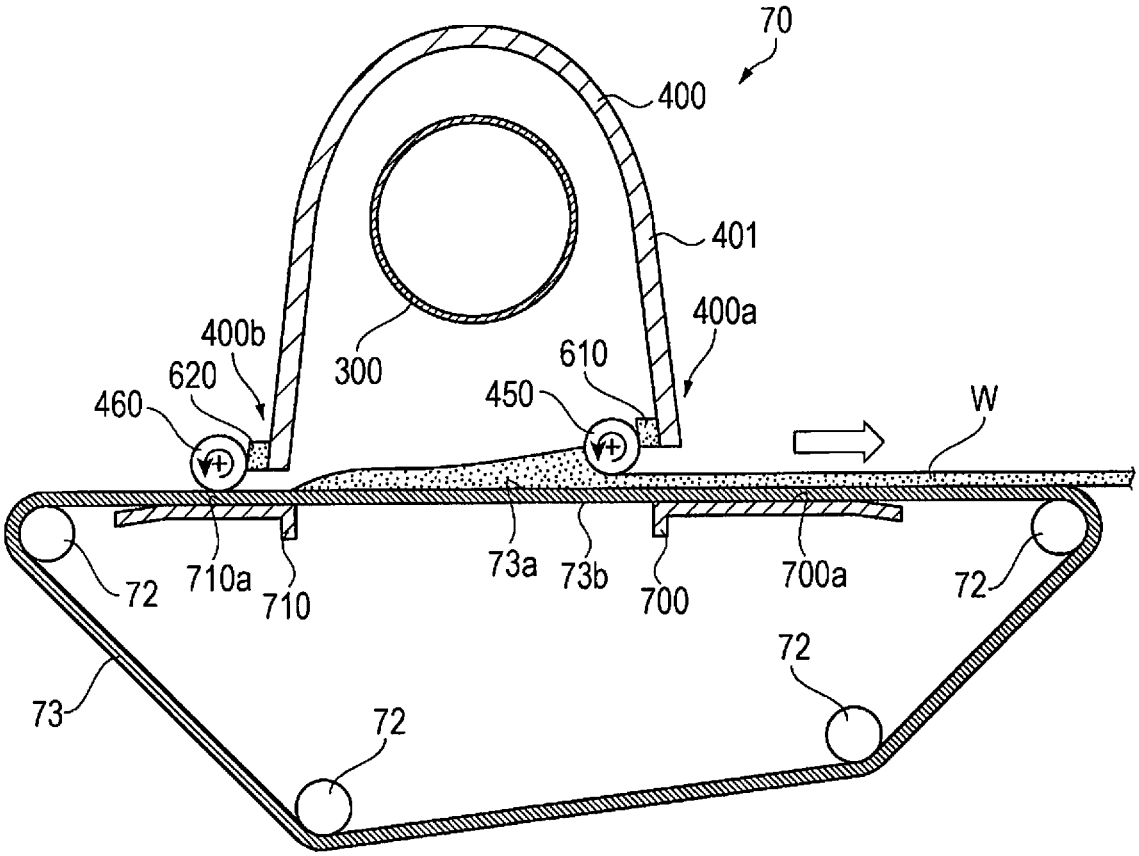
FIG. 6 is a schematic view illustrating configurations of an accumulation unit and a periphery thereof according to Modification Example 1.

In the embodiments described above, the first roller 450 is disposed on the outside of the housing unit 400, but the first roller 450 is not limited to the configuration. For example, the first roller 450 may be disposed on the inside of the housing unit 400. FIG. 6 is a schematic view illustrating configurations of an accumulation unit and a periphery thereof according to the modification example. As illustrated in FIG. 6, it may be configured such that a first seal unit 610 is provided on an inner surface of a first side wall 400*a* of the housing unit 400 and the first roller 450 is disposed within the housing unit 400 so as to come into contact with the first seal unit 610. Even in the case, it is possible to obtain the same effects as the above description.

Modification Example 2

Figure 7:
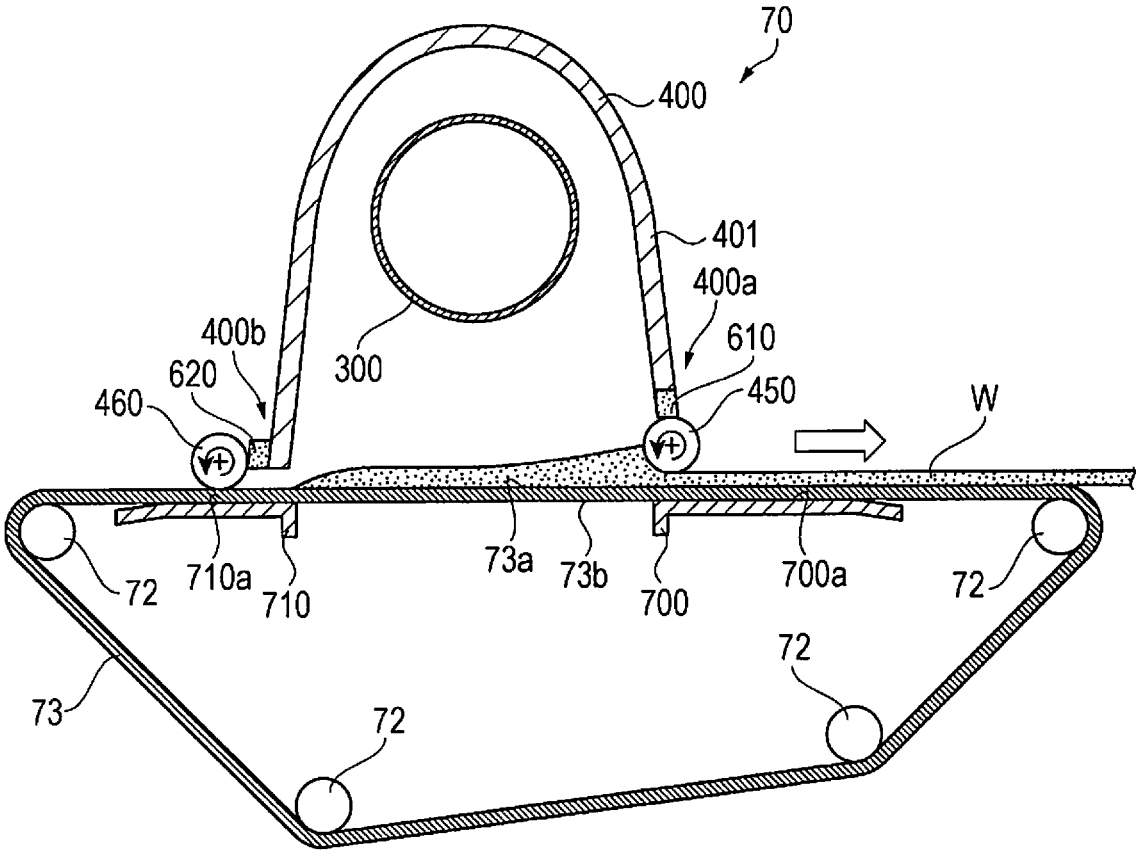
FIG. 7 is a schematic view illustrating configurations of an accumulation unit and a periphery thereof according to Modification Example 2.

In the embodiments described above, the first roller 450 is disposed on the outside of the housing unit 400, but the first roller 450 is not limited to the configuration. For example, the first roller 450 may be disposed on an end surface of a housing unit 400. FIG. 7 is a schematic view illustrating configurations of an accumulation unit and a periphery thereof according to the modification example. As illustrated in FIG. 7, it may be configured such that a first seal unit 610 is provided on the end surface of the first side wall 400*a* of the housing unit 400 and the first roller 450 is disposed so as to come into contact with the first seal unit 610 and to face the end surface of the first side wall. Even in the case, it is possible to obtain the same effects as the above description.

Modification Example 3

Figure 8:
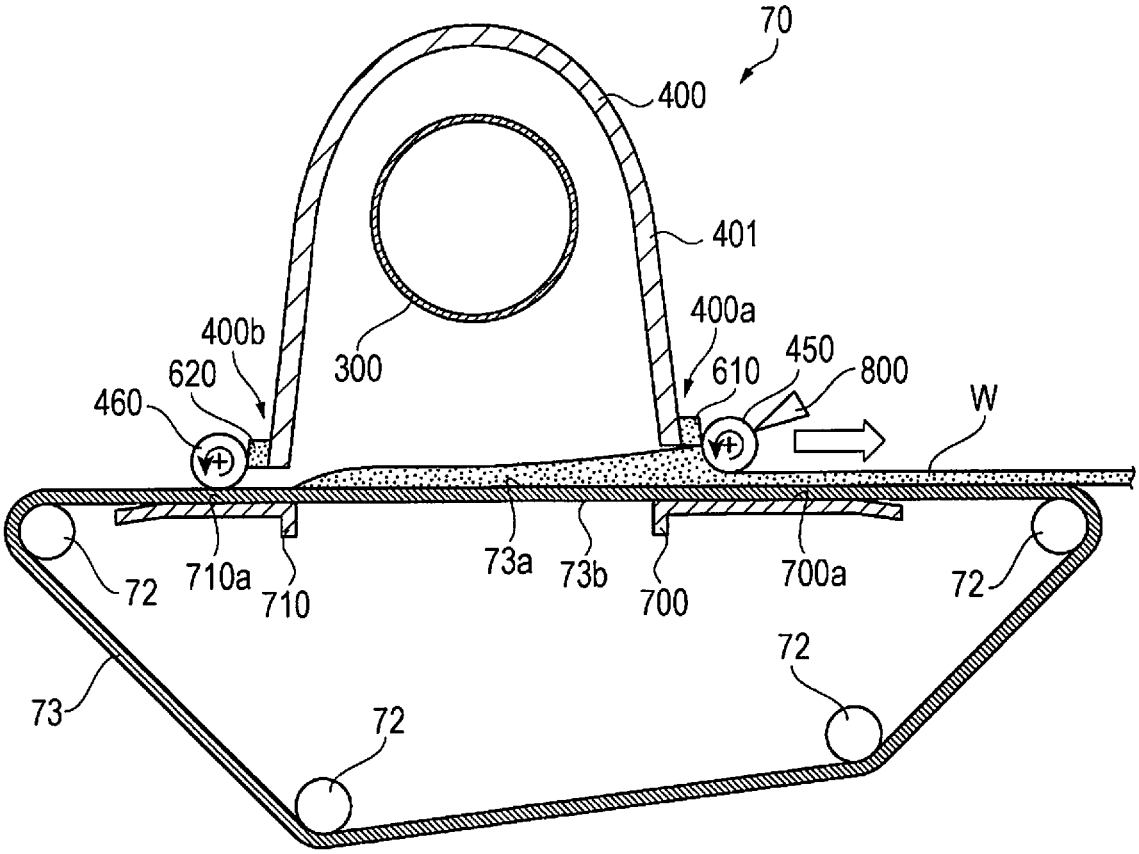
FIG. 8 is a schematic view illustrating configurations of an accumulation unit and a periphery thereof according to a modification example 3.

A removing unit for removing fine powder and the like attached to the first roller 450 may be provided. FIG. 8 is a schematic view illustrating configurations of an accumulation unit and a periphery thereof according to the modification example. As illustrated in FIG. 8, for example, a scraper 800 as the removing unit may be disposed in the vicinity of a surface (peripheral surface) of a first roller 450. Thus, fine powder and the like attached to the first roller 450 are removed by the scraper 800 and it is possible to suppress a decrease in transportability of the web W.

Modification Example 4

In the embodiments described above, the dimension of the mesh belt 73 in the direction orthogonal to the moving direction (the transport direction of the web W) of the mesh belt 73 is greater than that of the housing unit 400, but the dimension is not limited to the configuration. For example, the housing unit 400 is greater than the mesh belt 73 and a third seal unit 630 may be provided so as to abut the side surface (end surface) of the mesh belt 73. That is, the third seal unit 630 may be provided in a housing unit 400 so as to come into contact with a portion other than the outer surface 73*a* (surface on which the web W is accumulated) of the mesh belt 73. However, the third seal unit 630 may come into contact with at least one of the outer surface 73*a* and the inner surface 73*b* in addition to the end surface of the mesh belt 73.

The entire disclosure of Japanese Patent Application No. 2014-238487, filed Nov. 26, 2014 is expressly incorporated by reference herein.

What is claimed is:

1. A sheet manufacturing apparatus comprising:

a drum unit having a plurality of openings;

a housing unit covering the drum unit;

a transport unit on which a material containing fibers passing through the openings is accumulated as a web and which transports the accumulated web;

a first roller that abuts the web transported by the transport unit; and a first seal unit that is provided on a first side wall of the housing unit and comes into contact with the first roller, a peripheral speed of the first roller being faster than a transport speed of the web by the transport unit.

2. The sheet manufacturing apparatus according to claim 1, further comprising:

a second roller that is positioned further on an upstream side than the first roller in a transport direction of the web; and a second seal unit that is provided on a second side wall facing the first side wall of the housing unit and comes into contact with the second roller.

3. The sheet manufacturing apparatus according to claim 1, wherein the transport unit includes a belt that transports the web, and wherein the apparatus further comprises a first belt support plate that faces the first roller to interpose the belt therebetween.

4. The sheet manufacturing apparatus according to claim 2, wherein the transport unit includes a belt that transports the web, and wherein the apparatus further comprises a second belt support plate that faces the second roller to interpose the belt therebetween.

5. The sheet manufacturing apparatus according to claim 1, wherein the transport unit includes a belt that transports the web, and wherein the apparatus further comprises a third roller that faces the first roller to interpose the belt therebetween.

6. The sheet manufacturing apparatus according to claim 2, wherein the transport unit includes a belt that transports the web, and wherein the apparatus further comprises a fourth roller that faces the second roller to interpose the belt therebetween.

7. A sheet manufacturing apparatus comprising:

a drum having a plurality of openings;

a housing covering the drum;

a belt on which a material containing fibers passing through the openings is accumulated as a web and which transports the accumulated web;

a first roller that abuts the web transported by the belt; and a seal that is provided on a first side wall of the housing and comes into contact with the first roller, a peripheral speed of the first roller being faster than a transport speed of the web by the belt.

* * * * *